US007526090B2

(12) United States Patent
Cross

(10) Patent No.: US 7,526,090 B2
(45) Date of Patent: Apr. 28, 2009

(54) SECURED RADIO COMMUNICATIONS METHOD

(75) Inventor: Gary J. Cross, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 1552 days.

(21) Appl. No.: 10/042,505

(22) Filed: Jan. 9, 2002

(65) Prior Publication Data

US 2003/0131231 A1 Jul. 10, 2003

(51) Int. Cl.
*H04K 1/02* (2006.01)

(52) U.S. Cl. ..... 380/252

(58) Field of Classification Search ..... 713/188–194; 380/28–30, 252
See application file for complete search history.

(56) References Cited

U.S. PATENT DOCUMENTS 5,305,384 A * 4/1994 Ashby et al. ..... 380/29
5,410,599 A * 4/1995 Crowley et al. ..... 380/269
5,519,778 A * 5/1996 Leighton et al. ..... 380/30
5,581,576 A * 12/1996 Lanzetta et al. ..... 375/216
5,815,553 A * 9/1998 Baugh et al. ..... 379/88.17
5,880,721 A * 3/1999 Yen ..... 725/81
5,909,491 A * 6/1999 Luo ..... 380/270
5,915,021 A * 6/1999 Herlin et al. ..... 705/67
5,978,481 A * 11/1999 Ganesan et al. ..... 380/266
6,122,263 A 9/2000 Dahlin et al. ..... 370/329
6,151,677 A * 11/2000 Walter et al. ..... 713/183
6,169,805 B1 1/2001 Dunn et al. ..... 380/277
6,240,074 B1 5/2001 Chandos et al. ..... 370/321
6,246,672 B1 6/2001 Lumelsky ..... 370/310
6,249,810 B1 6/2001 Kiraly ..... 709/217

OTHER PUBLICATIONS

Mohapatra P K, Public key cryptography, Fall 2000, ACM, vol. 7, Issue 1, pp. 14-22.*

* cited by examiner

*Primary Examiner*—Brandon S Hoffman
(74) *Attorney, Agent, or Firm*—Yee & Associates, P.C.; David A. Mims, Jr.

(57) ABSTRACT

A data processing system, method, and product are disclosed for securing radio transmissions utilizing a conventional radio. A conventional radio and a computer system are provided. The computer system is separate and apart from the conventional radio. The conventional radio is capable of receiving an input analog signal from a microphone and then transmitting the input analog signal. The conventional radio is incapable of encrypting the input analog signal. The computer system is coupled between the microphone and the radio such that inputs into the microphone are received first by the computer system. The computer system receives an input from the microphone, encrypts the input utilizing public key encryption, and passes the encrypted input to the radio. The radio then transmits the encrypted input. Thus, radio transmissions from the conventional radio are secured.

9 Claims, 3 Drawing Sheets

SECURED RADIO COMMUNICATIONS METHOD

CROSS REFERENCE TO RELATED APPLICATIONS

The subject matter of the present invention is related to the subject matter of pending U.S. patent application Ser. No. 10/042,496, entitled "SECURE CELLULAR TELEPHONE COMMUNICATIONS SYSTEM, METHOD, AND COMPUTER PROGRAM PRODUCT", flied on the same date herewith, which is assigned to the same assignee and hereby incoworated by references.

BACKGROUND OF THE INVENTION

1. Technical Field

The present invention relates generally to the field of radio transmissions and, more specifically to a system, method, and computer program product for securing radio communications utilizing a conventional radio.

2. Description of Related Art

Conventional radios transmit and receive information utilizing radio signals. Conventional radios receive inputs typically from a microphone coupled to a microphone port on the radio. These inputs are then transmitted by the radio at a particular frequency. All radios capable of receiving the particular frequency may receive the transmission because conventional radios do not have any encryption capability to insure secured transmissions.

When a conventional radio receives an analog radio signal, the receiving radio processes the analog signal in order to output that analog signal to a speaker. When a conventional radio receives an encrypted analog signal, the radio has no means by which to decrypt the analog signal.

Secured radio communications are essential to the military. They must purchase specialized equipment in order to transmit and receive secured radio communications.

Personal computer systems are well known in the art. They have attained widespread use for providing computer power to many segments of today's modern society. Personal computers (PCs) may be defined as a desktop, floor standing, or portable microcomputer that includes a system unit having a central processing unit (CPU) and associated volatile and non-volatile memory, including random access memory (RAM) and basic input/output system read only memory (BIOS ROM), a system monitor, a keyboard, one or more flexible diskette drives, a CD-ROM drive, a fixed disk storage drive (also known as a "hard drive"), a pointing device such as a mouse, and an optional network interface adapter. One of the distinguishing characteristics of these systems is the use of a motherboard or system planar to electrically connect these components together.

Encryption algorithms are known to ensure that only the intended recipient of an electronic message may read and access the message. One known encryption algorithm is an asymmetric, or public key, algorithm. The public key algorithm is a method for encrypting electronic messages sent from a first entity to a second entity. This algorithm provides for a key pair comprised of a private key and public key which are mathematically related such that if the private key is used to encrypt data then only the matched public key can be used to decrypt the data, and visa versa.

Encryption keys may be obtained from a certificate authority. Certificate Authorities are entities that can issue digital certificates. Certificate Authorities are, in essence, a commonly trusted third party that is relied upon to verify the matching of public keys to identity, e-mail name, or other such information.

Therefore, a need exists for a method, system, and product for securing radio communications utilizing a conventional radio.

SUMMARY OF THE INVENTION

A data processing system, method, and product are disclosed for securing radio transmissions utilizing a conventional radio. A conventional radio and a computer system are provided. The computer system is separate and apart from the conventional radio. The conventional radio is capable of receiving an input analog signal from a microphone and then transmitting the input analog signal. The conventional radio is incapable of encrypting the input analog signal. The computer system is coupled between the microphone and the radio such that inputs into the microphone are received first by the computer system. The computer system receives an input from the microphone, encrypts the input utilizing public key encryption, and passes the encrypted input to the radio. The radio then transmits the encrypted input. Thus, radio transmissions from the conventional radio are secured.

The above as well as additional objectives, features, and advantages of the present invention will become apparent in the following detailed written description.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE PREFERRED EMBODIMENT

A preferred embodiment of the present invention and its advantages are better understood by referring to the figures, like numerals being used for like and corresponding parts of the accompanying figures.

The present invention is a system, method, and computer program product for securing radio communications. A secured radio communications system includes a conventional radio, a computer system, a microphone, and a speaker. The computer system is coupled between the microphone and the microphone input port of the radio, and also between the speaker and the speaker output port of the radio. The conventional radio is not capable of encrypting or decrypting transmissions.

An analog signal may be received by the microphone. The computer system then receives the analog signal from the microphone before the analog signal is input into the radio. The computer system encrypts the analog signal using public key encryption. Once the analog signal is encrypted, the computer system passes the encrypted analog signal to the radio. The radio then transmits the encrypted analog signal.

Another secured radio communications system may then receive the encrypted analog signal. The second secured radio communications system includes a conventional radio, a computer system, a microphone, and a speaker. The computer system is coupled between the microphone and the microphone input port of the radio, and also between the speaker and the speaker output port of the radio. The second conventional radio may receive the transmitted encrypted analog signal. Once the conventional radio receives the encrypted analog signal, it outputs the encrypted analog signal through its speaker port. The second computer system receives outputs from the radio's speaker port. The second computer system then decrypts the encrypted analog signal using public key encryption. The second computer system then outputs the decrypted analog signal to the speaker.

The second secured radio communications system may also receive an input through its microphone, encrypt the input analog signal using the second computer system, output the encrypted analog signal to the second conventional radio, and transmit the encrypted analog signal using the radio. The first secured radio communications system may then receive the encrypted analog signal using the first conventional radio, pass the encrypted analog signal from the radio out its speaker port to the first computer system, decrypt the analog signal using the first computer system, and output the decrypted analog signal from the first computer system to the speaker.

The first and second secured radio communications systems may exchange encryption keys using one of many different methods. For example, the two computer systems may exchange keys prior to any transmissions.

Figure 1:
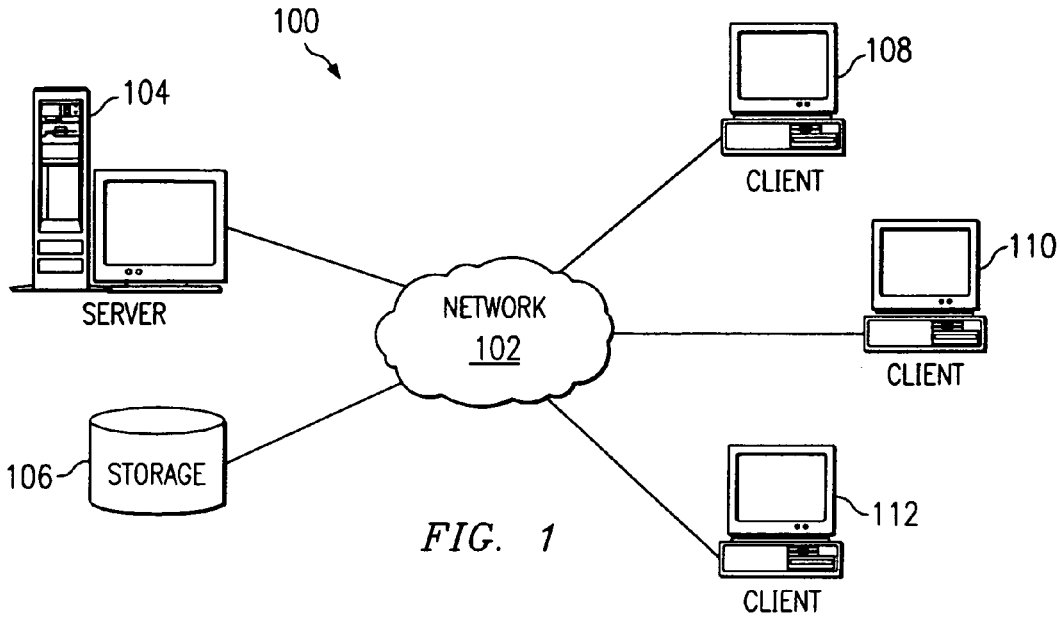
FIG. 1 is a pictorial representation which depicts a data processing system in which the present invention may be implemented in accordance with a preferred embodiment of the present invention.

FIG. 1 depicts a pictorial representation of a network of data processing systems in which the present invention may be implemented. Network data processing system 100 is a network of computers in which the present invention may be implemented. Network data processing system 100 contains a network 102, which is the medium used to provide communications links between various devices and computers connected together within network data processing system 100. Network 102 may include connections, such as wire, wireless communication links, or fiber optic cables.

In the depicted example, a server 104 is connected to network 102 along with storage unit 106. In addition, clients 108, 110, and 112 also are connected to network 102. Network 102 may include permanent connections, such as wire or fiber optic cables, or temporary connections made through telephone connections. The communications network 102 also can include other public and/or private wide area networks, local area networks, wireless networks, data communication networks or connections, intranets, routers, satellite links, microwave links, cellular or telephone networks, radio links, fiber optic transmission lines, ISDN lines, T1 lines, DSL, etc. In some embodiments, a user device may be connected directly to a server 104 without departing from the scope of the present invention. Moreover, as used herein, communications include those enabled by wired or wireless technology.

Clients 108, 110, and 112 may be, for example, personal computers, portable computers, mobile or fixed user stations, workstations, network terminals or servers, cellular telephones, kiosks, dumb terminals, personal digital assistants, two-way pagers, smart phones, information appliances, or network computers. For purposes of this application, a network computer is any computer, coupled to a network, which receives a program or other application from another computer coupled to the network.

In the depicted example, server 104 provides data, such as boot files, operating system images, and applications to clients 108-112. Clients 108, 110, and 112 are clients to server 104. Network data processing system 100 may include additional servers, clients, and other devices not shown. In the depicted example, network data processing system 100 is the Internet with network 102 representing a worldwide collection of networks and gateways that use the TCP/IP suite of protocols to communicate with one another. At the heart of the Internet is a backbone of high-speed data communication lines between major nodes or host computers, consisting of thousands of commercial, government, educational and other computer systems that route data and messages. Of course, network data processing system 100 also may be implemented as a number of different types of networks, such as for example, an intranet, a local area network (LAN), or a wide area network (WAN). FIG. 1 is intended as an example, and not as an architectural limitation for the present invention.

Figure 2:
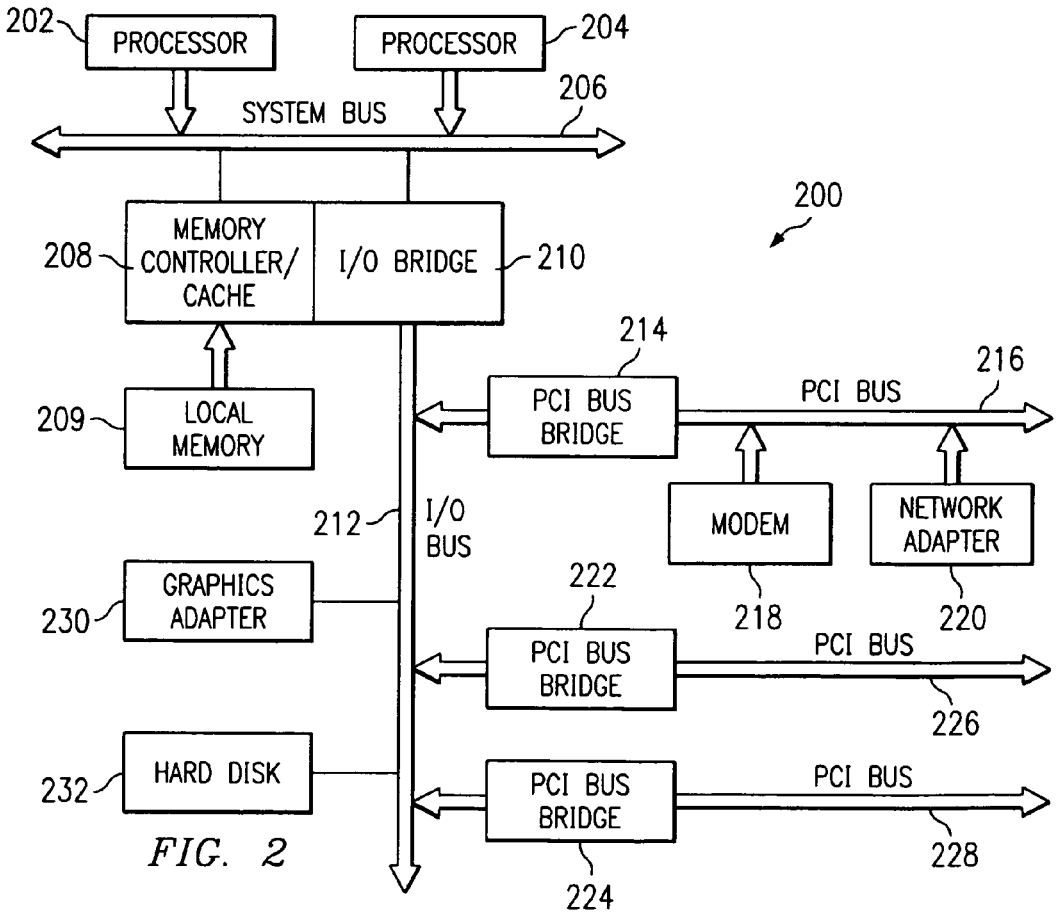
FIG. 2 illustrates a block diagram of a computer system which may be utilized as a server computer system in accordance with the present invention.

Referring to FIG. 2, a block diagram of a data processing system that may be implemented as a server, such as server 104 in FIG. 1, is depicted in accordance with a preferred embodiment of the present invention. Data processing system 200 may be a symmetric multiprocessor (SMP) system including a plurality of processors 202 and 204 connected to system bus 206. One or more of the processors include a performance monitor along with performance monitor counters. Alternatively, a single processor system may be employed. Also connected to system bus 206 is memory controller/cache 208, which provides an interface to local memory 209. I/O bus bridge 210 is connected to system bus 206 and provides an interface to I/O bus 212. Memory controller/cache 208 and I/O bus bridge 210 may be integrated as depicted.

Peripheral component interconnect (PCI) bus bridge 214 connected to I/O bus 212 provides an interface to PCI local bus 216. A number of modems may be connected to PCI bus 216. Typical PCI bus implementations will support four PCI expansion slots or add-in connectors. Communications links to network computers 108-112 in FIG. 1 may be provided through modem 218 and network adapter 220 connected to PCI local bus 216 through add-in boards.

Additional PCI bus bridges 222 and 224 provide interfaces for additional PCI buses 226 and 228, from which additional modems or network adapters may be supported. In this manner, data processing system 200 allows connections to multiple network computers. A memory-mapped graphics adapter 230 and hard disk 232 may also be connected to I/O bus 212 as depicted, either directly or indirectly.

Those of ordinary skill in the art will appreciate that the hardware depicted in FIG. 2 may vary. For example, other peripheral devices, such as optical disk drives and the like, also may be used in addition to or in place of the hardware depicted. The depicted example is not meant to imply architectural limitations with respect to the present invention.

The data processing system depicted in FIG. 2 may be, for example, an IBM RISC/System 6000 system, a product of International Business Machines Corporation in Armonk, N.Y., running the Advanced Interactive Executive (AIX) operating system.

Figure 3:
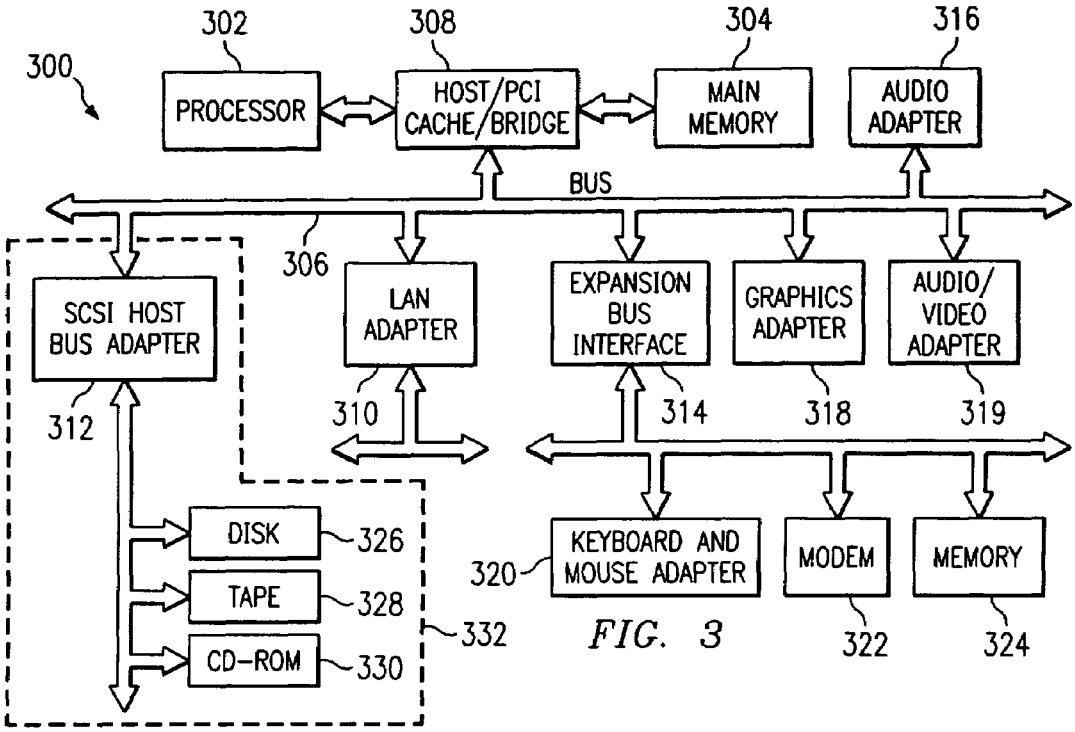
FIG. 3 depicts a block diagram of a computer system which may be utilized as a client computer system in accordance with the present invention.

With reference now to FIG. 3, a block diagram illustrating a data processing system is depicted in which the present invention may be implemented. Data processing system 300 is an example of a client computer. Data processing system 300 employs a peripheral component interconnect (PCI) local bus architecture. Although the depicted example employs a PCI bus, other bus architectures such as Accelerated Graphics Port (AGP) and Industry Standard Architecture (ISA) may be used. Processor 302 and main memory 304 are connected to PCI local bus 306 through PCI bridge 308. PCI bridge 308 also may include an integrated memory controller and cache memory for processor 302. Additional connections to PCI local bus 306 may be made through direct component interconnection or through add-in boards. In the depicted example, local area network (LAN) adapter 310, SCSI host bus adapter 312, and expansion bus interface 314 are connected to PCI local bus 306 by direct component connection. In contrast, audio adapter 316, graphics adapter 318, and audio/video adapter 319 are connected to PCI local bus 306 by add-in boards inserted into expansion slots. Expansion bus interface 314 provides a connection for a keyboard and mouse adapter 320, modem 322, and additional memory 324. Small computer system interface (SCSI) host bus adapter 312 provides a connection for hard disk drive 326, tape drive 328, and CD-ROM drive 330. Typical PCI local bus implementations will support three or four PCI expansion slots or add-in connectors.

An operating system runs on processor 302 and is used to coordinate and provide control of various components within data processing system 300 in FIG. 3. The operating system may be a commercially available operating system, such as Windows 2000, which is available from Microsoft Corporation. An object oriented programming system such as Java may run in conjunction with the operating system and provide calls to the operating system from Java programs or applications executing on data processing system 300. "Java" is a trademark of Sun Microsystems, Inc. Instructions for the operating system, the object-oriented operating system, and applications or programs are located on storage devices, such as hard disk drive 326, and may be loaded into main memory 304 for execution by processor 302.

Those of ordinary skill in the art will appreciate that the hardware in FIG. 3 may vary depending on the implementation. Other internal hardware or peripheral devices, such as flash ROM (or equivalent nonvolatile memory) or optical disk drives and the like, may be used in addition to or in place of the hardware depicted in FIG. 3. Also, the processes of the present invention may be applied to a multiprocessor data processing system.

As another example, data processing system 300 may be a stand-alone system configured to be bootable without relying on some type of network communication interface, whether or not data processing system 300 comprises some type of network communication interface. As a further example, data processing system 300 may be a Personal Digital Assistant (PDA) device, which is configured with ROM and/or flash ROM in order to provide non-volatile memory for storing operating system files and/or user-generated data.

The depicted example in FIG. 3 and above-described examples are not meant to imply architectural limitations. For example, data processing system 300 also may be a notebook computer or hand held computer in addition to taking the form of a PDA. Data processing system 300 also may be a kiosk or a Web appliance.

Figure 4:
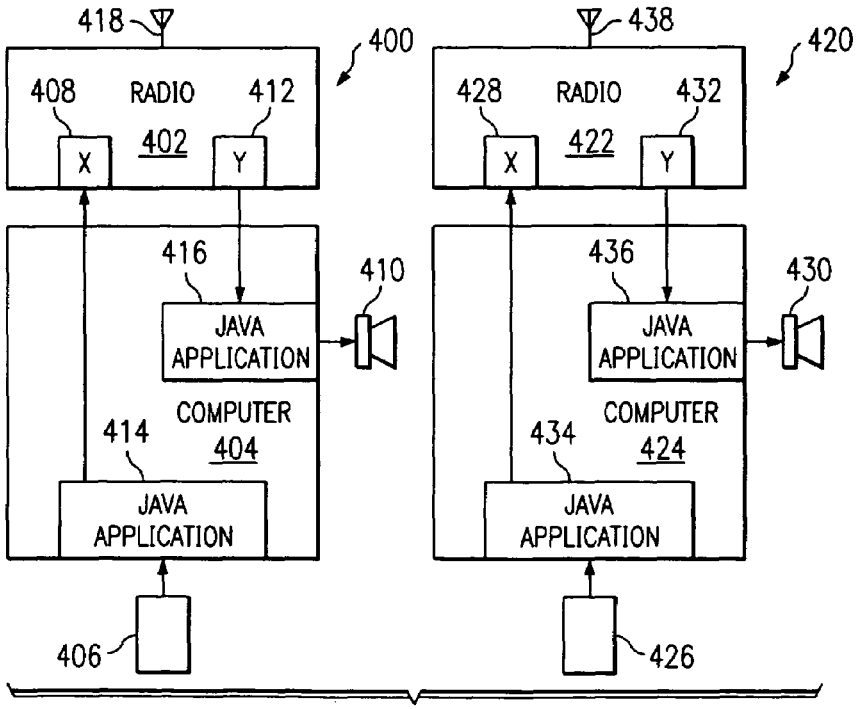
FIG. 4 is a block diagram of two secured radio communications systems in accordance with the present invention.

FIG. 4 is a block diagram of two secured radio communications systems in accordance with the present invention. A first secured radio communications system 400 includes a conventional radio 402, and a computer system 404. Computer system 404 is interconnected between a microphone 406 and a microphone port 408 input into radio 402. Computer system 404 is also interconnected between a speaker 410 and a speaker port 412 output from radio 402.

A Java application 414, being executed by computer system 404, constantly monitors a logical input microphone port and receives input voice data from microphone 406. Another Java application 416, also being executed by computer system 404, constantly monitors speaker port 412, receives voice data from radio 402, and outputs voice data using speaker 410.

Secured radio communications system 400 may transmit radio signals to and receive radio signals from another secured radio communications system, such as system 420, using an antenna 418.

Secured radio communications system 420 includes a conventional radio 422, and a computer system 424. Computer system 424 is interconnected between a microphone 426 and a microphone port 428 input into radio 422. Computer system 424 is also interconnected between a speaker 430 and a speaker port 432 output from radio 422.

A client computer system, such as client 108, or a server, such as server 104, may be utilized to implement computer system 404 or computer system 424.

A Java application 434, being executed by computer system 424, constantly monitors a logical input microphone port and receives input voice data from microphone 426. Another Java application 436, also being executed by computer system 424, constantly monitors speaker port 432, receives voice data from radio 422, and outputs voice data using speaker 430.

Secured radio communications system 424 may transmit radio signals to and receive radio signals from another secured radio communications system, such as system 400, using an antenna 438.

When secured radio communications system 400 receives an input through microphone 406, a microphone driver executing within computer system 404 receives the input data and puts that data into a standardized format voice file, such as a "wav" file. Java application 414, which is constantly monitoring the logical microphone input port, detects the receipt of this voice file. Java application 414 then encrypts the voice file and transmits the encrypted voice file to the physical microphone input port 408 located within radio 402. Radio 402 transmits this encrypted voice file using antenna 418 and known technology.

Radio 422 included within secured radio communications system 420 receives, through antenna 438, a radio transmission of an encrypted voice file. Radio 422 outputs the received encrypted voice file through its physical speaker output port 432. Java application 436, which is constantly monitoring speaker output port 432, receives this encrypted voice file. Java application 436 then obtains the private key of secured radio communications system 420. Java application 436 decrypts the encrypted voice file using the obtained private key. Java application then outputs the decrypted voice file through speaker 430.

In a manner similar to that described above, system 420 obtains a public key/private key pair from a certificate authority as known in the art. System 420 then receives a voice input through microphone 426. Java application 434, encrypts the input voice file, and outputs the encrypted file to microphone port 428. Radio 422 transmits the encrypted file using antenna 438.

Radio 402 receives the encrypted file using antenna 418 and outputs the received file through speaker port 412. Java application 416 then receives the encrypted file, obtains the private key of system 420, uses this private key to decrypt the received encrypted file, and then outputs the decrypted file using speaker 410. Public and private keys may be shared among secured radio communications systems as described above. For example, the keys may be exchanged prior to the use of the systems.

Figure 5:
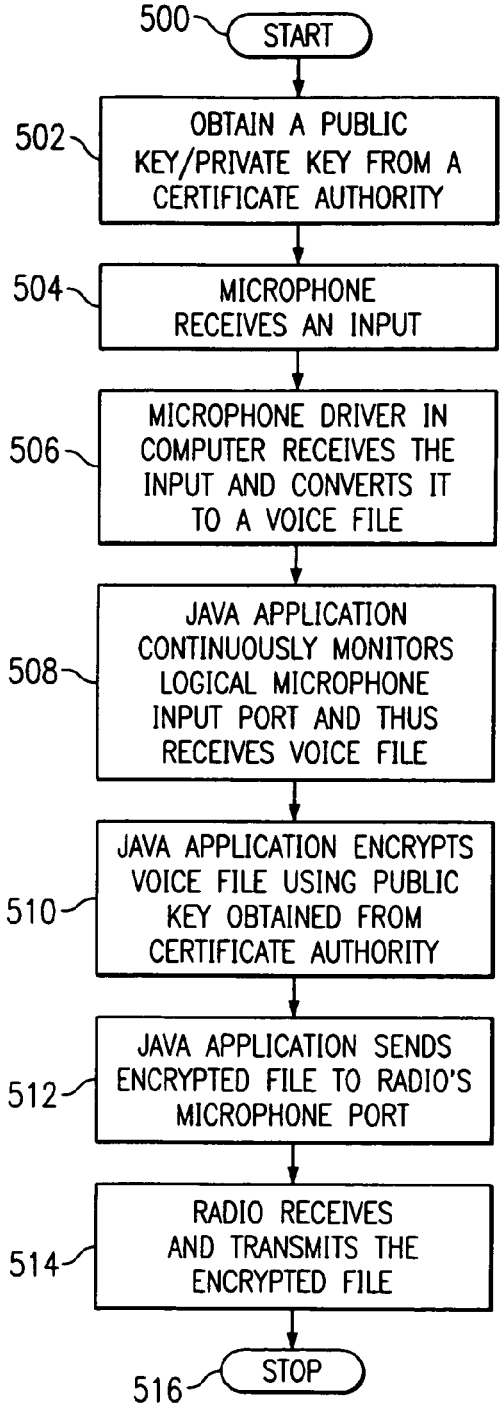
FIG. 5 depicts a high level flow chart which illustrates a secured radio communication system receiving a voice file, encrypting the voice file, and transmitting the encrypted voice file in accordance with the present invention.

FIG. 5 depicts a high level flow chart which illustrates a secured radio communication system receiving a voice file, encrypting the voice file, and transmitting the encrypted voice file in accordance with the present invention. The process starts as depicted by block 500 and thereafter passes to block 502 which illustrates a secured radio communications system obtaining a public key and private key from a certificate authority. Next, block 504 depicts a microphone included in the secured radio communications system receiving a voice input. Block 506 illustrates a microphone driver in a computer system that is a part of the secured radio communications system receiving the voice input and converting it to a voice file. This voice file may be in a standard format, such as a "wav" format.

The process then passes to block 508 which depicts a Java application that is continuously executing within the computer system monitoring a logical microphone input port. The Java application uses JNI (Java Native Interface) to make calls to native application software programs that receive the voice file from the microphone driver. The Java application will thus receive the voice file via JNI. Next, block 510 illustrates the Java application encrypting the voice file using the public key obtained from the certificate authority. Thereafter, block 512 depicts the Java application sending the encrypted file to the radio's input microphone port. The radio is also included within this secured radio communications system. Next, block 514 illustrates this radio receiving the encrypted file through its microphone port and then transmitting the encrypted file. The process then terminates as depicted by block 516.

Figure 6:
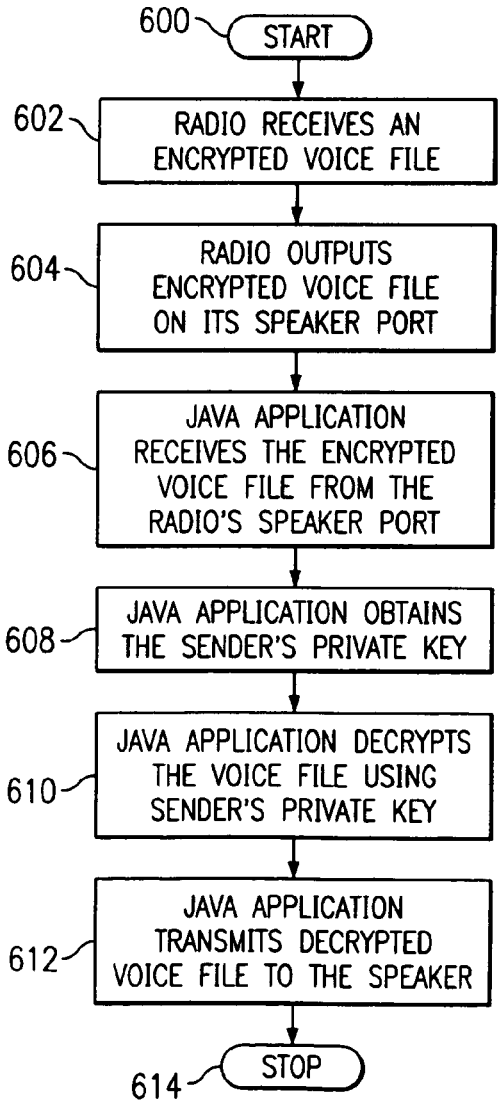
FIG. 6 illustrates a high level flow chart which depicts a secured radio communication system receiving an encrypted voice file, decrypting the received voice file, and outputting via a speaker the decrypted voice file in accordance with the present invention.

FIG. 6 illustrates a high level flow chart which depicts a secured radio communication system receiving an encrypted voice file, decrypting the received voice file, and outputting via a speaker the decrypted voice file in accordance with the present invention. The process starts as depicted by block 600 and thereafter passes to block 602 which illustrates a radio included within a secured radio communications system receiving an encrypted voice file. Next, block 604 depicts the radio outputting this encrypted voice file on its output speaker port. Block 606, then, illustrates a Java application that is executing on a computer included within this secured radio communications system receiving the encrypted voice file from the radio's speaker port.

The process then passes to block 608 which depicts the Java application obtaining the private key of the system that sent the voice file. This private key may be obtained using any one of many different methods. One simple approach would be for the sending secured radio communications system and the receiving secured radio communications to exchange one or more keys prior to any radio transmission. In a preferred embodiment, both the sender and the receiver of the radio transmission will share the private key and public key in a manner such as described by U.S. Pat. No. 6,169,805 B1, which is herein incorporated by reference.

Thereafter, block 610 illustrates the Java application decrypting the voice file using the sender's private key. Next, block 612 depicts the Java application transmitting the decrypted voice file to a speaker included within the secured radio communications system via JNI. The process then terminates as illustrated by block 614.

It is important to note that while the present invention has been described in the context of a fully functioning data processing system, those of ordinary skill in the art will appreciate that the processes of the present invention are capable of being distributed in the form of a computer readable medium of instructions and a variety of forms and that the present invention applies equally regardless of the particular type of signal bearing media actually used to carry out the distribution. Examples of computer readable media include recordable-type media, such as a floppy disk, a hard disk drive, a RAM, CD-ROMs, DVD-ROMs, and transmission-type media, such as digital and analog communications links, wired or wireless communications links using transmission forms, such as, for example, radio frequency and light wave transmissions. The computer readable media may take the form of coded formats that are decoded for actual use in a particular data processing system.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A method for securing radio transmissions utilizing a conventional radio, said method comprising the steps of:

providing a conventional radio, said conventional radio being incapable of encrypting or decrypting signals, said radio including a conventional microphone port that is configured to be coupled to a conventional microphone and a conventional speaker port that is configured to be coupled to a conventional speaker, said radio remaining unmodified;

providing a computer system coupled between a microphone and said radio, wherein inputs into said radio are received first by said computer system, said computer system being separate and apart from said radio;

receiving, within said computer system, an input analog signal from said microphone;

encrypting, within said computer system, said input analog signal utilizing public key encryption to form an encrypted voice file;

passing said encrypted voice file from said computer system to said microphone port that is included within said unmodified radio; and transmitting said encrypted voice file utilizing said unmodified radio, wherein radio transmissions from said radio are secured.

2. The method according to claim 1, further comprising the step of encrypting, within said computer system, said input analog signal utilizing a key pair, said key pair including a public key and a private key.

3. The method according to claim 2, further comprising the step of encrypting, within said computer system, said input analog signal utilizing said public key.

4. The method according to claim 1, wherein the receiving step comprises:

receiving, within a first application executing within said computer system, said input analog signal from said microphone;

wherein the encrypting step comprises encrypting, utilizing said first application, said input analog signal utilizing public key encryption to form said encrypted voice file;

wherein the passing step comprises passing said encrypted voice file from said first application to said microphone port of said unmodified radio.

5. The method according to claim 1, wherein the receiving step comprises:

converting, by a microphone driver that is executing within said computer system, said input analog signal to a file, said file being in a standard voice file format;

constantly monitoring, by a first application, inputs received from said microphone; and detecting, by said first application, a receipt of said file;

wherein the encryption step comprises in response to a detection by said first application of said receipt of said file, encrypting to form said encrypted voice file, by said first application utilizing a public key that is part of a public key/private key pair assigned to said computer system.

6. The method according to claim 1, further comprising the steps of:

providing a second conventional radio, said second conventional radio being incapable of encrypting or decrypting signals, said second radio including a second microphone port that is configured to be coupled to a second conventional microphone and a second speaker port that is configured to be coupled to a second conventional speaker, said second radio remaining unmodified;

providing a second computer system coupled between said second speaker and said second unmodified radio, wherein outputs from said second radio are received first by said second computer system before being output to said second speaker, said second computer system being separate and apart from said second radio;

receiving, within said second computer system, an encrypted output from said second speaker port included within said unmodified second radio;

decrypting, within said second computer system, said encrypted output utilizing public key encryption to form a decrypted output; and outputting said decrypted output from said second computer system to said second speaker.

7. The method according to claim 6, wherein within said second computer system the step of receiving further comprises:

constantly monitoring, by a second application that is executing within said second computer system, said second speaker port;

receiving, by said second application, said encrypted output from said second speaker port;

wherein the decrypting step comprises decrypting, by said second application, said encrypted output utilizing public key encryption.

8. The method according to claim 7, further comprising the steps of:

obtaining, by said second computer system, a private key of said computer system; and wherein the decrypting step further comprises decrypting said encrypted output utilizing said private key.

9. The method according to claim 8, farther comprising the step of exchanging said private key between said computer system and said second computer system prior to transmitting said encrypted voice file.

* * * * *